United States Patent [19]

Hatala

[11] Patent Number: 4,520,515

[45] Date of Patent: Jun. 4, 1985

[54] THREE POINT CLAMPING MEANS FOR A SHOWER BENCH

[75] Inventor: John Hatala, Clifton, N.J.

[73] Assignee: Temco Home Health Care Products, Inc., N.J.

[21] Appl. No.: 569,507

[22] Filed: Jan. 9, 1984

Related U.S. Application Data

[63] Continuation-in-part of Ser. No. 477,158, Mar. 21, 1983, Pat. No. 4,475,256.

[51] Int. Cl.[3] ..... A47K 3/022; A47K 3/12; A61H 33/02

[52] U.S. Cl. ..... 4/579; 4/559; 4/571; 4/573; 248/503.1; 248/225.31; 248/231.2; 297/252; 297/440

[58] Field of Search ..... 4/579, 573, 571, 559–565, 4/611; 248/500, 503.1, 225.31, 231.2; 297/252, 440

[56] References Cited

U.S. PATENT DOCUMENTS

| | | | |
|---|---|---|---|
| 2,465,026 | 3/1949 | Martz | 297/252 |
| 2,843,348 | 7/1958 | Samuels | 297/252 |
| 4,253,203 | 3/1981 | Thomas | 4/559 |
| 4,359,791 | 11/1982 | Thomas | 4/559 |
| 4,391,006 | 7/1983 | Smith | 4/559 |
| 4,472,844 | 9/1984 | Mace | 4/579 |

*Primary Examiner*—Henry K. Artis
*Attorney, Agent, or Firm*—Richard C. Woodbridge

[57] ABSTRACT

A three point clamping means is employed to secure one end of a shower bench to the edge of a bathtub. The bench includes two vertical feet which sit inside the bathtub, a pair of rails connected to said vertical feet and a clamping section. A chair unit is attachable to the rails and can be conveniently locked in position with respect thereto. A pair of C-shaped legs extend beyond the bathtub and make contact with the outside edge of said bathtub at two points. One point clamping contact is made on the inside of the bathtub by a single depending foot which includes a resilient pad mounted thereon. The depending foot is carried on a cross-brace slidably supported by said two rails and driven by a threaded crank mechanism. Rotation of the crank squeezes the bathtub edge at three points, namely, by the movable depending foot on the inside and by the two stationary C-shaped leg means on the outside. The improved clamping means is very easy to use and extremely secure compared to prior art clamping devices.

8 Claims, 11 Drawing Figures

Fig. 2c.
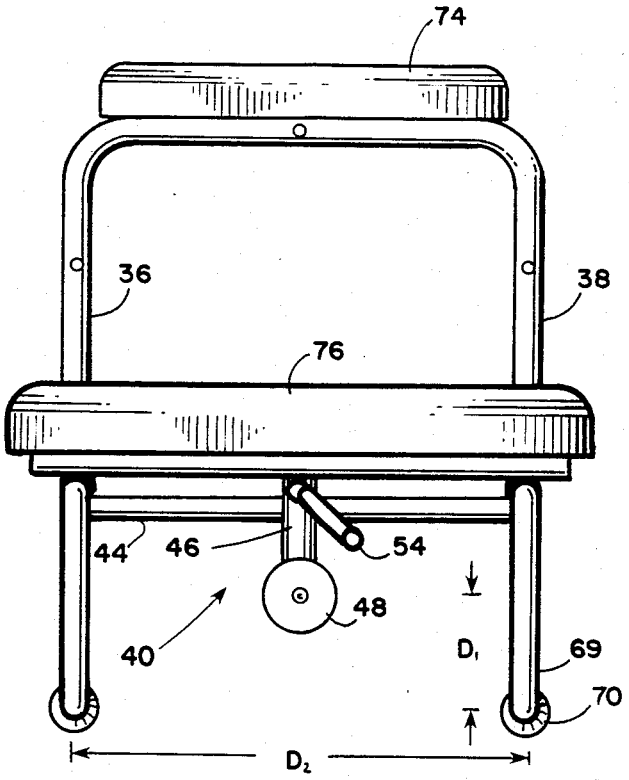
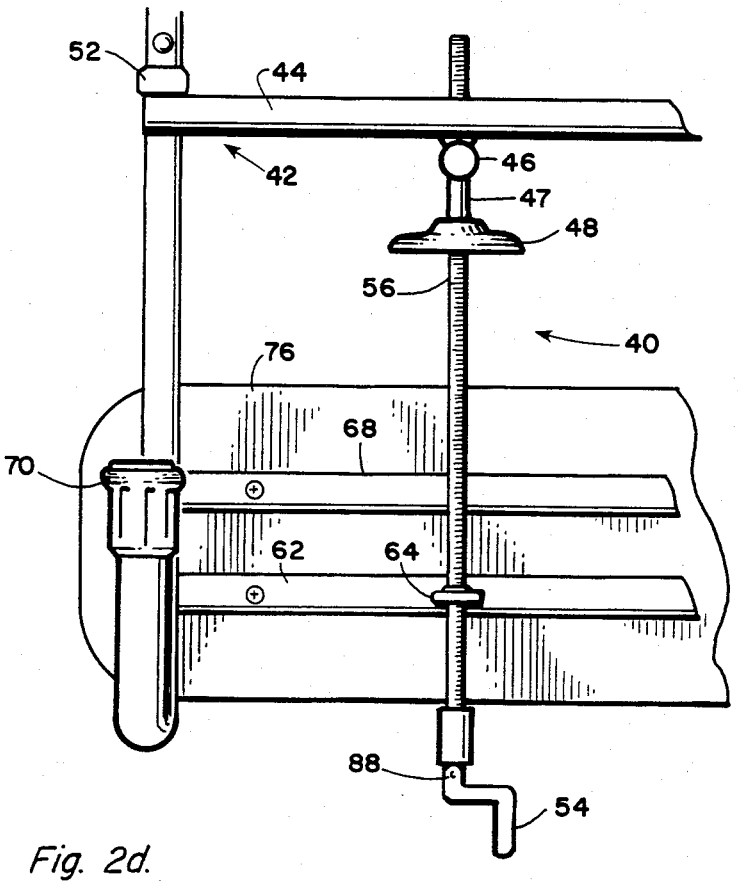
Fig. 2d.

THREE POINT CLAMPING MEANS FOR A SHOWER BENCH

CROSS-REFERENCE TO RELATED APPLICATIONS

This application is a continuation-in-part of Applicant's copending U.S. application entitled "SHOWER BENCH", Ser. No. 06/477,158 and filed on Mar. 21, 1983 now U.S. Pat. No. 4,475,256, all parts of which are hereby incorporated by reference into this disclosure.

BACKGROUND OF THE INVENTION

1. Field of the Invention

This invention relates to an improved clamping mechanism for attaching a shower bench to the edge of a bathtub.

2. Description of the Prior Art

The use of benches or chairs in a shower stall is known in the prior art. For example, Temco Home Health Care Products, Inc. 125 South Street, Passaic, N.J., manufactures a bathtub transfer bench, Model 1995 which comprises a horizontal platform supported by two pairs of legs. One pair of legs fits inside the bathtub and the other pair of legs sits outside the bathtub so that the bench seat straddles the edge of the bathtub. Temco Home Health Care Products, Inc. also produces shower chairs such as Models 1979, 1984 and 1985. Chairs may also be produced with or without backs, such in Models 1994 and 1996. Seating devices for showers are produced by other manufacturers as well.

One of the more advanced shower benches is described in U.S. Pat. Nos. 4,253,203 and 4,359,791. The inventor in both patents is Morton I. Thomas. U.S. Pat. No. 4,253,203 discloses a folding transfer bench which allows a patient to transfer from the exterior of a bathtub to the interior of a bathtub on a sliding chair. The chair is mountd on rollers which roll across a pair of parallel tracks from the outside to the inside of the bathtub and vice versa. U.S. Pat. No. 4,359,791 discloses an advanced version of the device disclosed in U.S. Pat. No. 4,253,203. Both patents relate to the Temco Home Health Care Products, Inc., Model 1999, also known as the "BIO-CARE® Bath Transfer Bench".

Another patent of possible interest is U.S. Pat. No. 4,391,006 entitled "Transfer Bench". The apparatus includes a four element clamping mechanism for securing the bench to the edge of a bathtub. A pair of rubber tipped feet are located on the outside of the bathtub and are opposed by a second pair of movable feet located on the inside of the bathtub. The movable feet are urged in the direction of the stationary feet by means of two knobs which each drive a threaded member attached to the movable feet. Each movable member is independently adjustable. However, the structure presents several problems. First, it requires more than one adjustment for appropriate locking. Secondly, the locking knobs are located on the inside of the bathtub—a difficult location for an invalid or an elderly person to reach. Third, it is not believed that the clamping action is as secure because it is believed that the individual threaded members are more likely to "back off" than other types of structures.

In view of the foregoing there does not appear to be any easy and secure mechanism for clamping a shower bench to the edge of a bathtub which could easily be used by the elderly or invalids, especially those suffering from arthritis or other dibilitating manual diseases.

SUMMARY OF THE INVENTION

Briefly described the invention comprises a shower bench that is exceptionally stable, yet relatively easy to use. The bench comprises a pair of rails supported at one end by the edge of the bathtub and at the other end by a pair of vertical legs. A sturdy clamping mechanism secures the pair of rails to the edge of the bathtub. The clamping mechanism is controlled by a single, easily manipulatable crank which urges a sliding cross-brace on the inside of the bathtub towards a pair of non-movable feet on the outside of the bathtub, thereby clamping the edge of the bathtub between the two. The movable jaw includes a single downward depending leg having a resilient pad attached thereto. The pad makes contact with the inside wall of the bathtub at a point approximately 2" above the point of contact of the feet on the outside of the bathtub and approximately half way between said two feet. A crank attached to a threaded member is used to drive the sliding cross-brace forwards and backwards. A hinge swivel attachment between the crank and the threaded member allows the crank handle to be pushed under the bench and out of the way when it is not being used.

A chair, described in detail in copending application Ser. No. 06/477,158 is attachable to the bench by hooking a pair of front hook-like brackets to one rail and by seating a pair of rear saddle-like brackets on the other rail. The back brackets are locked in position by means of a threaded bolt or stud. The front brackets are mounted horizontally so as to hook the first rail. This automatically sets the distance so that the second set of rear brackets engage the other rail. The rear brackets are mounted vertically so as to form an upside down "U" which straddles the other rail. Once the chair is in position it is virtually impossible to knock it over since the front hook brackets positively engage the front rail.

These and other aspects of the invention will be more fully understood with reference to the following drawings.

BRIEF DESCRIPTION OF THE DRAWINGS

FIG. 2C is an end view of the clamping section of the bench.

FIG. 2D is a detail view of the clamping mechanism as seen from underneath.

DETAILED DESCRIPTION OF THE INVENTION

During the course of this disclosure like numbers will be used to identify like elements that appear in the different figures which illustrate the invention. As stated previously, this is a continuation-in-part of the inventor's copending application, Ser. No. 06/477,158 filed on Mar. 21, 1983, all parts of which are hereby incorporated by reference. The numbering system employed in this disclosure is similar to that employed in the disclosure of application Ser. No. 06/477,158 in order to make this description easier to understand.

Figure 1A:
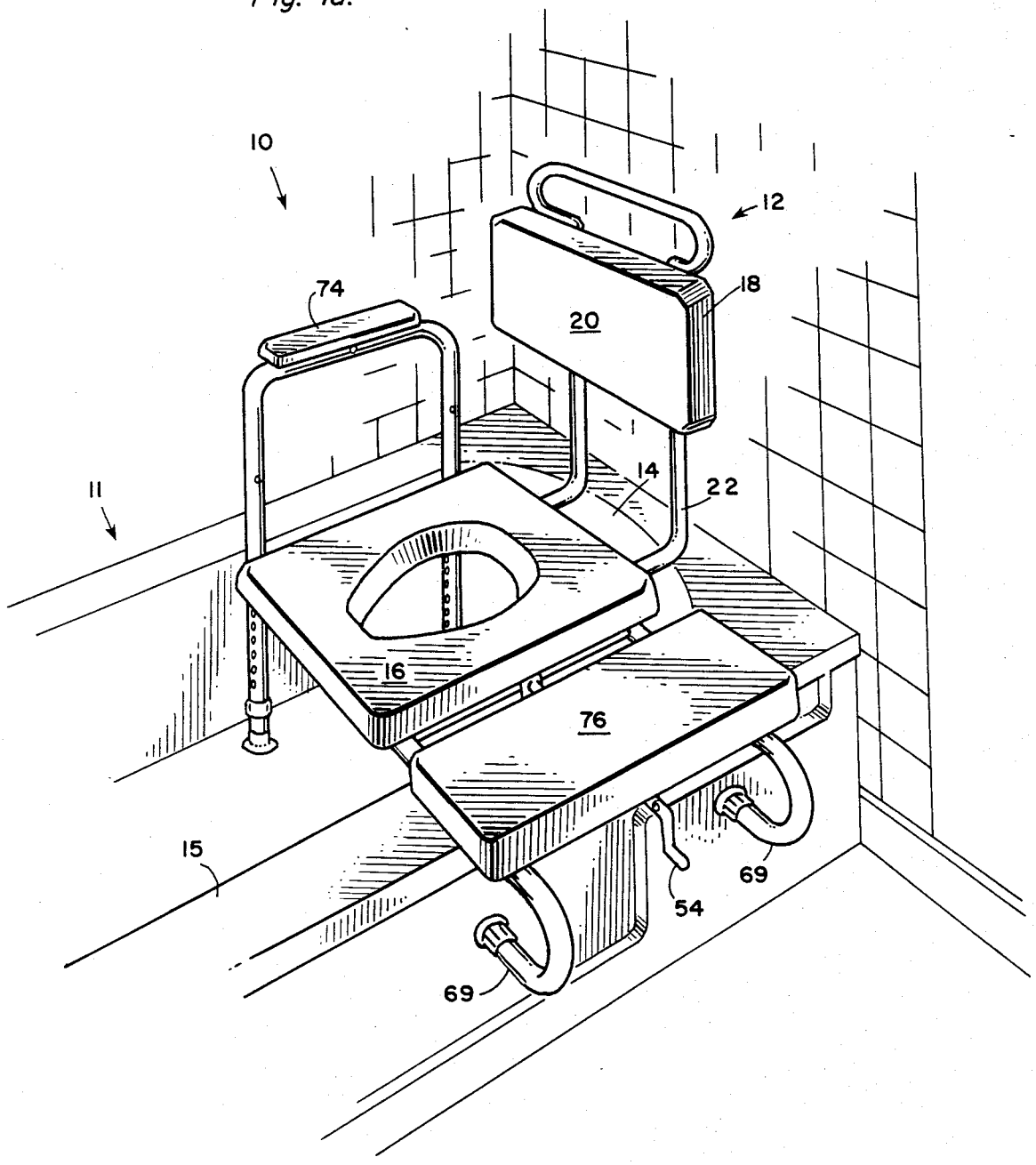
FIG. 1A is a front perspective view of the invention with the chair in place and with the crank handle extended.
Figure 1B:
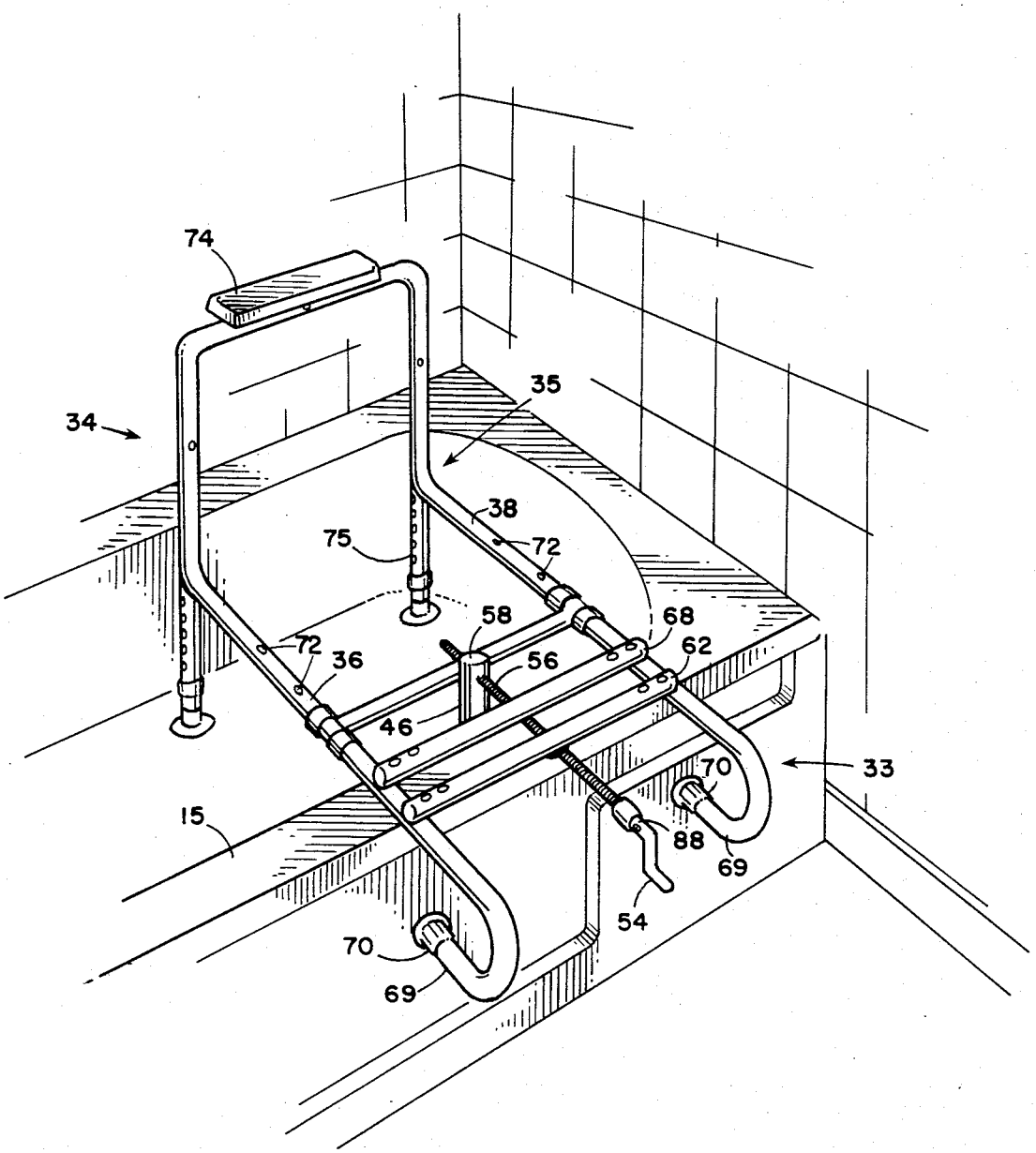
FIG. 1B is a front perspective view of the invention with the chair and all pads removed showing the manner in which the bench is attached to the edge of a conventional bathtub.
Figure 2A:
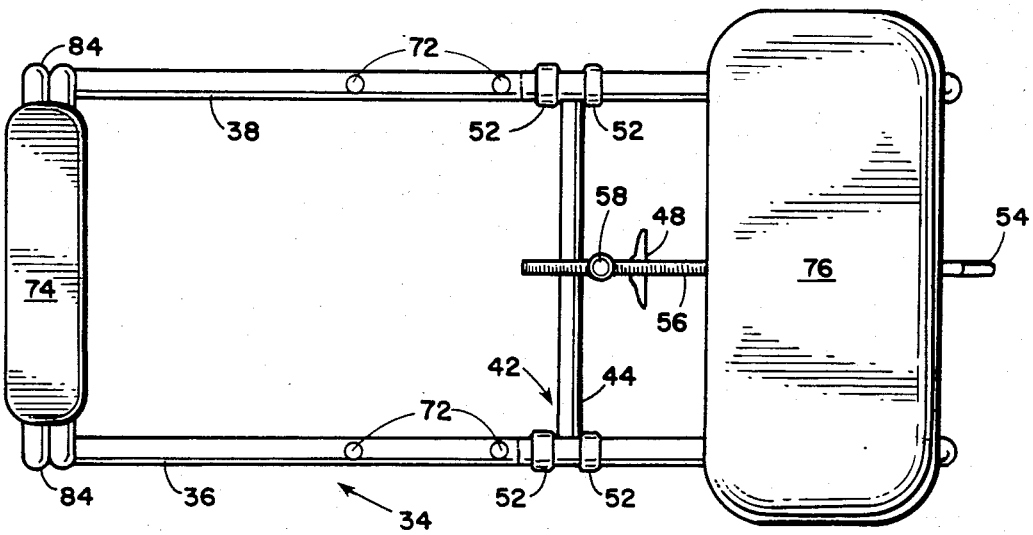
FIG. 2A if a top plan view of the bench without the chair.
Figure 2B:
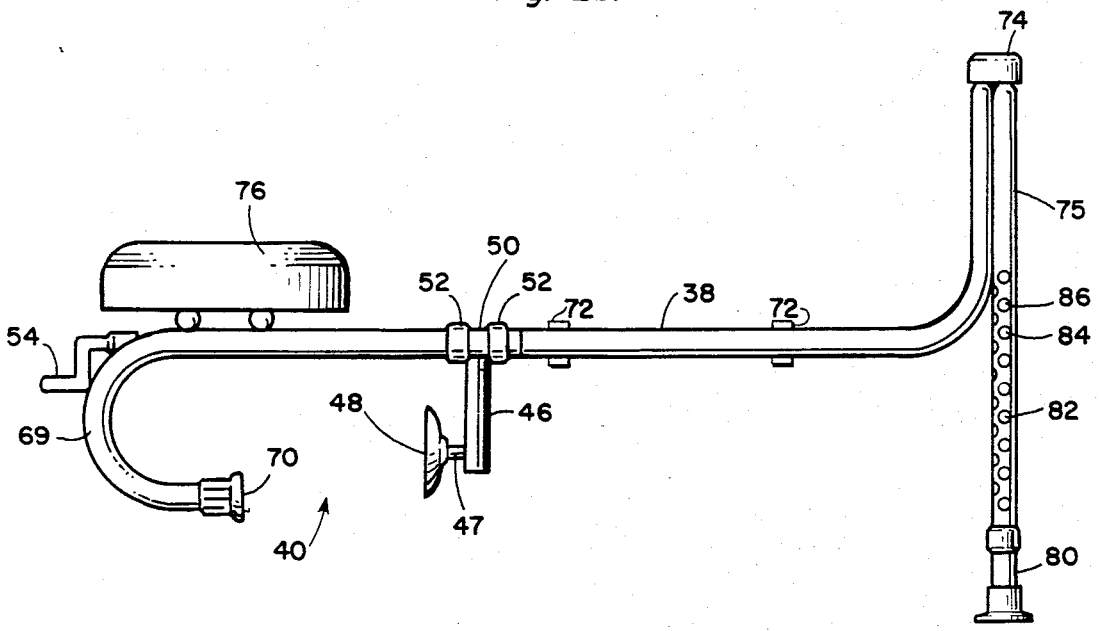
FIG. 2B is a side elevational view of the bench without the chair.

The invention 10 is shown in perspective view in FIG. 1A. The apparatus is typically mounted in a bathtub 11 in the manner shown. The invention 10 essentially comprises a chair unit 12 mounted on a rail bench unit 34. The details of the bench unit 34 are shown in FIGS. 2A through 2D where the chair 12 has been removed from the unit.

Details of the chair 12 can be more fully understood by reference to FIGS. 3A through 3E. Chair unit 12 comprises a seat section 14, a back section 18, and a chair frame 22 connecting the seat 14 section and the back 18 section together. A seat pad 16 is attached to seat section 14. Pad 16 includes an aperture 17 therein having a contour similar to that of a conventional toilet seat aperture. Back pad 20 is connected across the back section 18. Four screws 24 each are used to attach seat pad 16 and back pad 20 to frame 22 respectively.

Figure 3A:
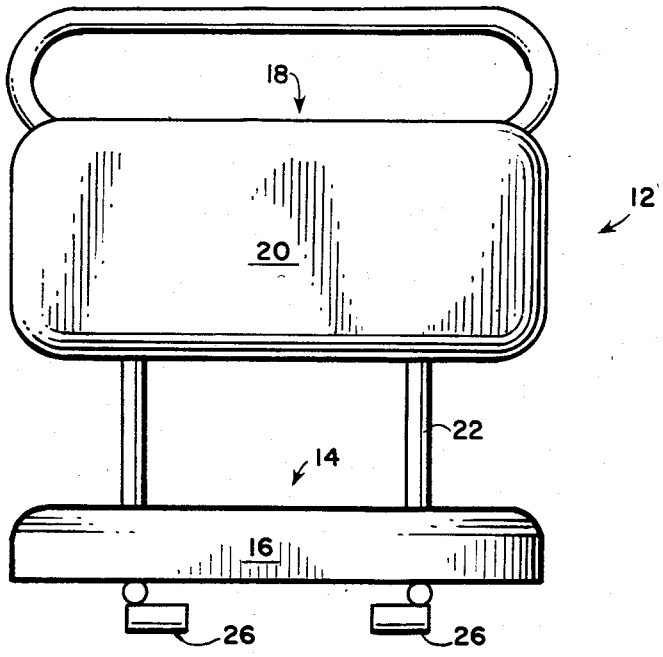
FIG. 3A is a front elevational view of the chair as seen from the front.
Figure 3B:
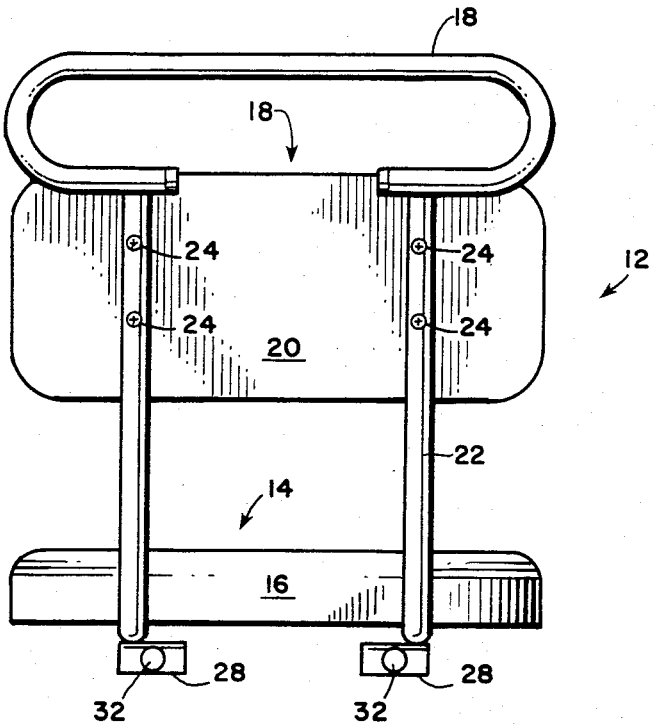
FIG. 3B is a rear elevational view of the chair unit alone.
Figure 3C:
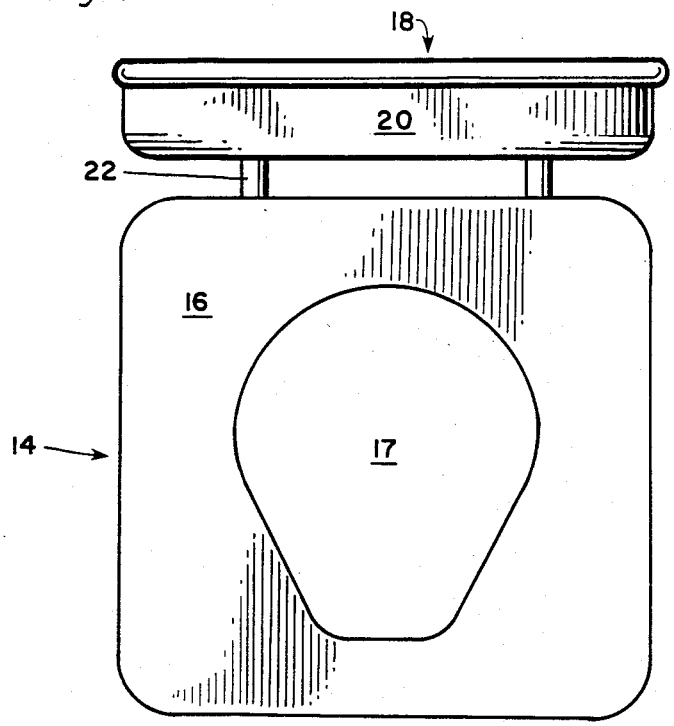
FIG. 3C is a top plan view of the chair unit alone showing the aperture in the seat thereof.
Figure 3D:
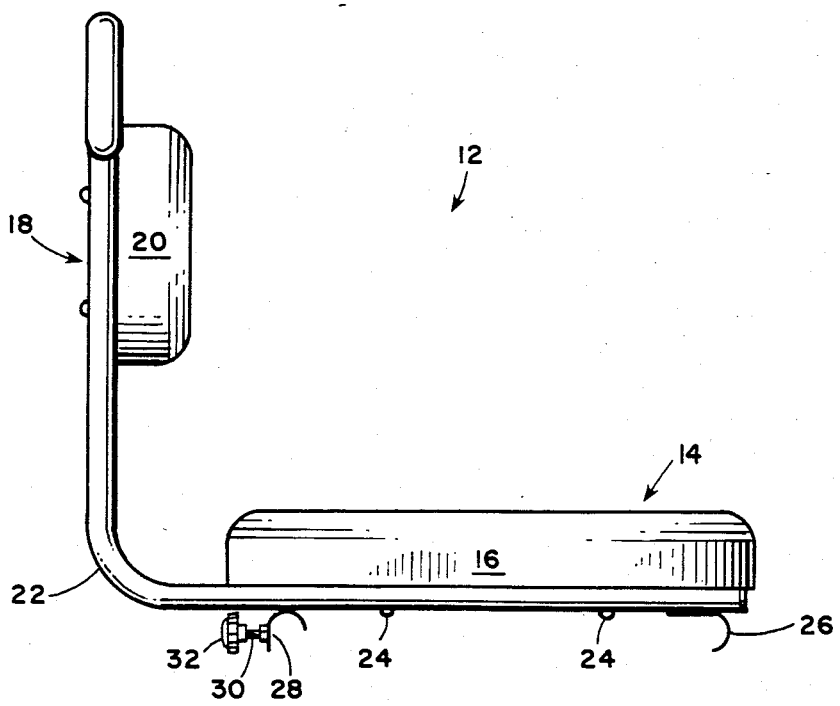
FIG. 3D is a side elevational view of the chair unit alone.
Figure 3E:
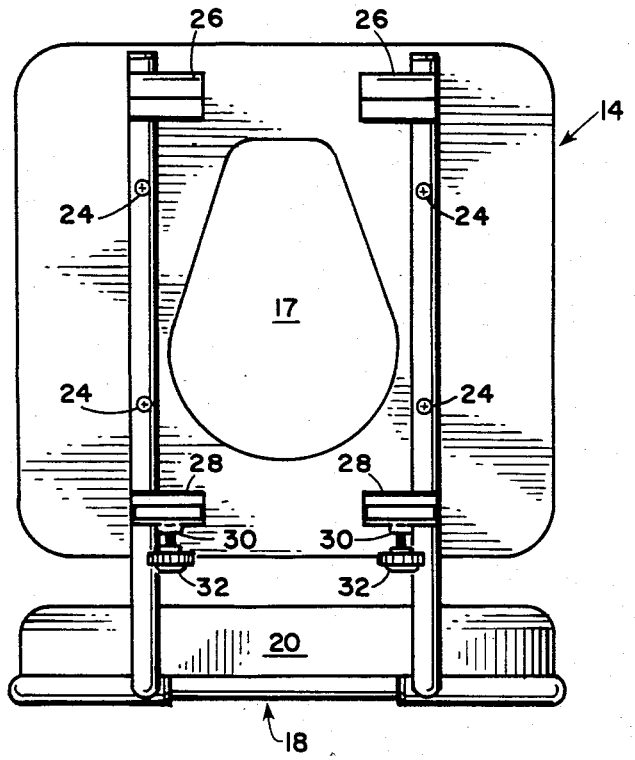
FIG. 3E is a bottom view of the chair unit alone also showing the aperture in the seat.

Two pairs of brackets 26 and 28 are attached to the underside of chair 12 as shown in detail in FIG. 3E. Brackets 26 and 28 are made from 13 gauge (0.089") $\frac{1}{4}$ hard steel $1\frac{7}{8}$" wide. The brackets are formed with a 0.505" to 0.507" radius with one leg being longer than the other. A 5/16" hole appears in the longer leg. Brackets 27 and 28 are brazed onto the bottom of the steel seat frame 22 in such a way as to become a rigid locking unit with respect to the rail bench unit 34. The front brackets 26 are mounted horizontally so as to snuggly hook onto the first rail 36 of bench 34. Front brackets 36 absolutely prevent backward tipping movement. Rear brackets 28 are mounted vertically attached to the 5/16" hole to the rear and with a $\frac{1}{4}$"-20 nut brazed or welded to the long leg of the bracket 28. A $\frac{1}{4}$"-20×$\frac{3}{4}$" long threaded stud 30 passes through the unit. A knob 32 is attached to the threaded stud 30 and needs to be tightened only lightly in order to lock the chair unit 12 to the bench unit 34. The locking is easily accomplished because the screw is located below the center of the second rail 38 and therefore gives positive interference to upward movement.

The chair frame 22 is preferably made from $\frac{7}{8}$"×0.049" steel welded tubing. It is bent and brazed to exact dimensions so that it can be easily removed or reversed as needed. The bench unit 34 is preferably made from 1"×0.049" wall annodized aluminum tubing with $\frac{7}{8}$"×0.049" wall aluminum tubing inside the 1" tubing for added strength and stability.

Lateral movement of the seat unit 12 is prevented by rivets 72 and washers placed on rails 36 and 38 and situated at predetermined locations so that the front brackets 26 just fit on either side of them. In this manner the brackets 26 straddle rivets 72 thereby substantially limiting the horizontal travel of the chair unit 12. Rivets 72 also serve to fasten the interior and exterior tubular elements of the bench unit 34 rigidly together.

Bench unit 34 is securely attached to the tub wall 15 of the shower by means of a clamping mechanism 40. Clamping mechanism 40 incorporates a sliding tubular section 42 which includes a nylon follower nut 58 centered in a transverse following cross brace 44.

A single downwardly depending leg 46 is attached midway between the two ends of cross brace 44 and oriented at 90° with respect thereto. Depending leg 46 preferably comprises $\frac{7}{8}$" tubing. Another section 47 is welded to downwardly depending leg 46 and at an angle of 90° with respect thereto also. Section 47 is adapted to accept the resilient rubber pad 48 which is adapted to make contact with the inside wall of bathtub 11. The resilient pad 48 is located a distance "D", or approximately 2" above the rubber feet 70 located on the outer section of the bench. Feet 70 are a distance $D_2$ apart and the resilient pad 48 is approximately midway (or $\frac{1}{2}$ $D_2$) therebetween (See FIG. 2C). Movable cross brace 44 is attached to rails 36 and 38 by means of sliding sleeves 50. Sliding sleeves 50 comprise 1 $\frac{1}{8}$" tubing which surround the 1" aluminum rail tubes 36 and 38. NYLON® bushings 52 are attached at opposite ends of the sleeves 50 and facilitate the sliding of the movable section of the clamping mechanism 40. A NYLON® follower nut 58 is captured in the top of downward depending leg 46. NYLON® nut 58 is tapped with a $\frac{3}{8}$-16 hole which is loose enough to allow for some mechanical play in the unit to avoid binding.

The front end of the unit includes a 1"×0.042" steel transverse mounting bar 62 having a 3/16"×1"×1" tab 64 brazed to the center thereof and projecting downwardly towards the bottom of the bench unit 34. Tab 64 includes a 13/32" hole in the center through which a $\frac{3}{8}$"16×13" threaded rod is inserted. Threaded rod 56 includes a $\frac{7}{8}$" O.D. washer brazed approximately 3" away from one end and a crank handle 54 attached to the same end. A swivel joint 88 attaches the crank handle 54 to the threaded member 56. Swivel 88 allows the crank 54 to be positioned under the bench pad 76 when not in use. A second washer is located on the opposite side of tab 64 from the first washer. This washer is welded in place at assembly. The two washers 66 allow the rod 56 to rotate freely in the hole but not to move in a backward or forward direction.

The bench unit 34 includes an outside of the tub section 33 and an inside of the tub section 35. The outside section 33 of the transfer bench unit 34 is structurally reinforced by a transverse bar 68. A pair of C-shaped legs 39 act as extensions of rails 36 and 38. Rubber feet 70 cap the C-shaped legs 69. Rails 36 and 38 telescope onto the C-shaped leg section 69 thereby increasing the effective wall thickness of the rails and improving the strength and rigidity of the bench unit 34. Covered pad 76 is primarily used as an initial seat when a patient first sits on the unit.

Section 35 of the transfer bench unit 34 sits inside of the bathtub 11 and includes a pair of legs 75. Legs 75 include an interior section 80 which telescopes into an exterior section 82 connected to the frame so that the legs 75 can extend or collapse according to the depth of the bathtub. The specific telescoping mechanism of the inside legs 75 and the locking buttons 84 and locking holes 86 associated therewith are believed to be known to those of ordinary skill in the art. An elbow pad 74 covers the top of the legs 75 and provides comfortable support for the patient using the invention 10.

The invention described has several advantages. First, the chair unit 12 is extra stable. The hook brackets 26 and rear brackets 28 make it virtually impossible to tip the chair backward or forward. Second, clamping mechanism 40 positively engages bathtub wall 15 thereby guaranteeing the ultimate stability of the bench unit 34 and the chair unit 12 as a whole. Third, the reinforced design of the rails 36 and 38 adds to the stability and rigidity of the unit. Fourth, it is relatively easy for a patient to install and use the invention. The device requires no special tools, skill, dexterity or strength. An arthritic patient can clamp the section 40 to the edge of a bathtub 15 using just one hand. Similarly, the chair unit 12 can be easily and securely attached to the bench unit 34 by means of brackets 26 and 28 and locking screw 30 and knob 32. Fifth, the improved crank handle mechanism is easier to grab. Sixth, the clamping unit is especially stable because it is a three-point clamp. In other words, the rubber feet 70 and the resilient pad 48 automatically adjust to the contour of the bathtub edge 15. If the bathtub edge 15 is irregular, the clamping mechanism works just as well. In previous embodiments, where 4 feet or more were used, the device was not found to be as stable. Prior art devices are similar to a four legged chair in which one of the legs is shorter than the other three. Applicant's mechanism is more similar to a three-legged stool which always makes good contact with the floor. Seventh, the use of a seat 16 having an aperture 17 therein is more comfortable for the typical patient who might be used to a seat 16 having a contour more similar to a toilet seat.

The invention has been described with reference to the preferred embodiment thereof. A number of modifications would, however, be possible within the inventive concept. For example, it may be possible to use stainless steel tubing as opposed to aluminum. Other types of materials could be used just as well. It may also be possible to replace the threaded rod 56 with a different type of drive mechanism. It will be appreciated by those of ordinary skill in the art that other changes can be made to the invention without departing from the spirit and scope thereof.

I claim:

1. A shower bench apparatus for use in a bathtub having an edge, said apparatus comprising:

at least two feet locatable inside of said bathtub;

a first and a second rail attached to said feet;

a chair unit attachable to said rails; and, a clamping means for attaching one end of said bench to the edge of said bathtub, said clamping means including:

a stationary portion attached to said first and second rails and locatable outside of said bathtub;

a slidable member also attached to said first and second rails and locatable within said bathtub; and, a hand operable means for driving said slidable member along said first and second rails, wherein rotation of said hand operable means causes said slidable member to engage the inside portion of said bathtub edge thereby clamping said bench to said bathtub.

2. The bench apparatus of claim 1 wherein said hand operable means includes:

a handle means;

a threaded means attached to said handle means;

a bracket means for supporting said threaded means; and, a following means for attaching said threaded means to said slidable member, whereby rotation of said handle means urges said slidable means towards and away from said stationary portion.

3. The bench apparatus of claim 2 wherein said stationary portion comprises:

a pair of "C"-shaped leg means attached to said first and second rails respectively and locatable outside of said tub; and, resilient feet means attached to said C-shaped leg means for engagement with the outside wall of said bathtub.

4. The bench apparatus of claim 3 wherein said slidable member comprises:

a cross brace means;

a first and second sleeve means attached to the opposite ends of said cross brace means, each of said sleeve means respectively surrounding said first and second rails;

a depending foot means attached to said cross brace means and located intermediate said first and second sleeve means; and, resilient means attached to said depending foot means for engagement with the inside wall of said bathtub.

5. The bench apparatus of claim 4 wherein the resilient feet means attached to said C-shaped leg means located on the outside of said bathtub are positioned approximately 2" below the resilient portion of said foot means attached to said slidable section and located on the inside of said bathtub.

6. The bench apparatus of claim 5 wherein said depending foot means attached to said slidable section applies pressure to the inside of the tub at a point which is approximately half way between and 2" above the points where the pressure applied by the resilient feet on the C-shaped leg sections is applied on the outside of said bathtub.

7. The bench apparatus of claim 6 wherein said two feet locatable inside of said bathtub are adjustable in length.

8. The apparatus of claim 7 wherein said handle means comprises a crank.

* * * * *